US009932824B2

(12) United States Patent
Yu et al.

(10) Patent No.: US 9,932,824 B2
(45) Date of Patent: Apr. 3, 2018

(54) COMPRESSION AND TRANSMISSION OF MEASUREMENTS FROM DOWNHOLE TOOL

(71) Applicant: Schlumberger Technology Corporation, Sugar Land, TX (US)

(72) Inventors: Bo Yu, Sugar Land, TX (US); Kai Hsu, Sugar Land, TX (US); Julian Pop, Houston, TX (US); Kentaro Indo, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 217 days.

(21) Appl. No.: 14/919,426

(22) Filed: Oct. 21, 2015

(65) Prior Publication Data

US 2017/0114634 A1 Apr. 27, 2017

(51) Int. Cl.
*G01V 3/00* (2006.01)
*E21B 47/12* (2012.01)

(52) U.S. Cl.
CPC ..... *E21B 47/123* (2013.01)

(58) Field of Classification Search
CPC ..... E21B 47/123
See application file for complete search history.

(56) References Cited

U.S. PATENT DOCUMENTS 5,530,959 A * 6/1996 Amrany ..... H04L 25/03866 380/268
6,724,829 B1 * 4/2004 Tzukerman ..... H04L 25/03866 375/295
6,819,260 B2 * 11/2004 Gardner ..... G01V 11/002 340/853.1
7,515,615 B2 * 4/2009 Peeters ..... H04J 13/00 370/515
7,680,600 B2 * 3/2010 Carnegie ..... G01V 1/48 166/250.01
7,805,247 B2 * 9/2010 Hsu ..... E21B 47/12 367/101

(Continued)

OTHER PUBLICATIONS

International Search Report and Written Opinion issued in corresponding International Application PCT/US2016/057431 dated Jan. 3, 2017. 11 pages.

*Primary Examiner* — Quang D Pham

(57) ABSTRACT

A method for transmitting data from a downhole tool is provided. In one embodiment, the method includes acquiring data for a formation fluid through downhole fluid analysis with a downhole tool in a well. The acquired data can include optical spectrum data measured with a spectrometer and other data. The method also includes generating time blocks of the acquired data and transmitting the time blocks from the downhole tool. More particularly, generating the time blocks may include compressing at least some of the optical spectrum data according to a first compression technique and compressing at least some of the other data according to one or more additional compression techniques. The compressed data can be packaged into the time blocks such that at least some of the time blocks include both compressed optical spectrum data and compressed other data for the formation fluid. Additional methods, systems, and devices are also disclosed.

13 Claims, 9 Drawing Sheets

(56) References Cited

U.S. PATENT DOCUMENTS 8,024,121 B2 * 9/2011 Tang ..... E21B 47/12 702/6
8,044,821 B2 * 10/2011 Mehta ..... E21B 47/12 340/855.5
8,060,311 B2 11/2011 Ramshaw et al.
8,730,764 B2 * 5/2014 Tang ..... G01V 1/003 341/80
8,904,044 B2 * 12/2014 Ebling ..... G06F 15/16 600/300
8,984,373 B2 * 3/2015 Yang ..... G06F 11/1048 714/766
8,996,947 B2 * 3/2015 Chung ..... G11C 11/5628 714/752
9,070,453 B2 * 6/2015 Sharon ..... G11C 11/5628
9,778,389 B2 * 10/2017 Stolpman ..... G01V 3/38
2006/0085644 A1 * 4/2006 Isozaki ..... G06F 21/10 713/171
2006/0188001 A1 * 8/2006 Mo ..... H04B 1/71632 375/130
2006/0248427 A1 * 11/2006 Katayama ..... G11B 20/1833 714/746
2009/0066959 A1 * 3/2009 DiFoggio ..... E21B 47/102 356/442
2009/0199072 A1 * 8/2009 Akimov ..... G01V 11/002 714/758
2009/0316528 A1 * 12/2009 Ramshaw ..... E21B 44/00 367/83
2010/0039286 A1 * 2/2010 Robbins ..... G01V 11/002 340/855.3
2011/0292932 A1 * 12/2011 Nichols ..... H04L 49/45 370/376
2012/0237036 A1 * 9/2012 Dabak ..... H05K 5/0278 380/287
2012/0257697 A1 * 10/2012 Zhou ..... H04B 7/1858 375/346
2013/0020074 A1 1/2013 Kischkat et al.
2013/0093597 A1 * 4/2013 Stolpman ..... G01V 3/38 340/854.3
2013/0124781 A1 * 5/2013 Sadashivappa ..... G11C 7/1006 711/103
2013/0135114 A1 5/2013 Ringer et al.
2014/0085098 A1 * 3/2014 Stolpman ..... G01V 3/18 340/854.4
2014/0286538 A1 * 9/2014 Yu ..... E21B 47/12 382/109
2014/0307975 A1 * 10/2014 DeForest ..... G06T 9/00 382/233
2015/0078625 A1 * 3/2015 Yu ..... E21B 47/12 382/109
2015/0109140 A1 4/2015 Probel et al.
2015/0137818 A1 5/2015 Nikitenko et al.
2015/0211363 A1 7/2015 Pop et al.
2015/0330168 A1 * 11/2015 Sun ..... E21B 47/06 700/282
2016/0003036 A1 * 1/2016 Mickael ..... E21B 47/14 367/82
2016/0208603 A1 * 7/2016 Barfoot ..... E21B 47/123
2016/0273335 A1 * 9/2016 Quintero ..... G01V 5/101

* cited by examiner

COMPRESSION AND TRANSMISSION OF MEASUREMENTS FROM DOWNHOLE TOOL

BACKGROUND

Wells are generally drilled into subsurface rocks to access fluids, such as hydrocarbons, stored in subterranean formations. The formations penetrated by a well can be evaluated for various purposes, including for identifying hydrocarbon reservoirs within the formations. During drilling operations, one or more drilling tools in a drill string may be used to test or sample the formations. Following removal of the drill string, a wireline tool may also be run into the well to test or sample the formations. These drilling tools and wireline tools, as well as other wellbore tools conveyed on coiled tubing, drill pipe, casing, or other means of conveyance, are also referred to herein as "downhole tools." Certain downhole tools may include two or more integrated collar assemblies, each for performing a separate function, and a downhole tool may be employed alone or in combination with other downhole tools in a downhole tool string.

Formation evaluation may involve drawing fluid from a formation into a downhole tool. In some instances, downhole fluid analysis is used to test the fluid while it remains in the well. Such analysis, which can be performed with sensors of downhole tools, is used to provide information on certain fluid properties in real time without the delay associated with returning fluid samples to the surface. Information obtained through downhole fluid analysis can be used as inputs to various modeling and simulation techniques to estimate the properties or behavior of fluid in a reservoir. This obtained information may be transmitted from the downhole tool to the surface in various manners. In some instances, such formation fluid information may be obtained with a downhole tool of a drill string and the information can be transmitted to the surface through mud-pulse telemetry.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

In one embodiment of the present disclosure, a method includes acquiring data for a formation fluid through downhole fluid analysis with a downhole tool in a well. The downhole tool has a spectrometer, and the acquired data includes optical spectrum data for the formation fluid measured with the spectrometer, as well as other data for the formation fluid. The method also includes transmitting a portion of the acquired data from the downhole tool. Transmitting this portion of the acquired data includes generating time blocks of the acquired data and transmitting the time blocks from the downhole tool toward a surface installation. Further, generating the time blocks includes compressing at least some of the acquired optical spectrum data according to a first compression technique and compressing at least some of the acquired other data for the formation fluid according to at least one additional compression techniques. The compressed optical spectrum data and compressed other data for the formation fluid may be packaged into the time blocks such that at least some of the time blocks include both compressed optical spectrum data and compressed other data for the formation fluid.

In another embodiment, a method includes acquiring data for multiple data channels with a downhole tool in a well. The multiple data channels include first and second subsets of data channels, with the first subset of data channels including optical spectrum data channels having optical spectrum measurements obtained with a spectrometer of the downhole tool. The method also includes communicating data of the first and second subsets of data channels from the downhole tool to an analysis system outside the well. This communicating of the data can include selecting data from the first subset of data channels at a higher sample rate than from the second subset of data channels and compressing the selected data from the first and second subsets of data channels. Further, compressing the selected data from the first subset of data includes compressing selected optical spectrum measurements from different channels of the optical spectrum data channels together as a group. The compressed data may be transmitted from the downhole tool using mud-pulse telemetry.

In a further embodiment, an apparatus includes a downhole tool having a flowline, an intake for receiving a fluid within the flowline, and at least one measurement device for acquiring data for the fluid. The at least one measurement device includes a spectrometer positioned to acquire optical data for the fluid. The downhole tool also includes a controller for preparing the acquired data for transmission in accordance with a transmission mode selected from multiple available transmission modes programmed into the controller. The multiple available transmission modes include a first transmission mode, in which acquired optical data for each wavelength channel of the spectrometer is to be transmitted, and a second transmission mode, in which acquired optical data for just some of the wavelength channels of the spectrometer is to be transmitted along with fluid composition data computed downhole for the fluid.

Various refinements of the features noted above may exist in relation to various aspects of the present embodiments. Further features may also be incorporated in these various aspects as well. These refinements and additional features may exist individually or in any combination. For instance, various features discussed below in relation to the illustrated embodiments may be incorporated into any of the above-described aspects of the present disclosure alone or in any combination. Again, the brief summary presented above is intended just to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

It is to be understood that the present disclosure provides many different embodiments, or examples, for implementing different features of various embodiments. Specific examples of components and arrangements are described below for purposes of explanation and to simplify the present disclosure. These are, of course, merely examples and are not intended to be limiting.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not mandate any particular orientation of the components.

The present disclosure relates to compression and transmission of data, such as data acquired with a downhole tool within a well. More particularly, some embodiments of the present disclosure relate to compressing formation fluid data acquired with a downhole tool to facilitate transmission of the data to the surface via mud-pulse telemetry. The formation fluid data can include optical data and non-optical data, which can be compressed and packaged into a series of time blocks for transmission. The time blocks may be packaged and transmitted in accordance with various transmission modes, as discussed in greater detail below. Further, the optical data may include optical density data from different wavelength channels, and the optical density data from the different wavelength channels may be grouped together for compression. Additionally, multiple compression techniques may be run in parallel to select the technique that yields the fewest output bits at runtime.

Figure 1:
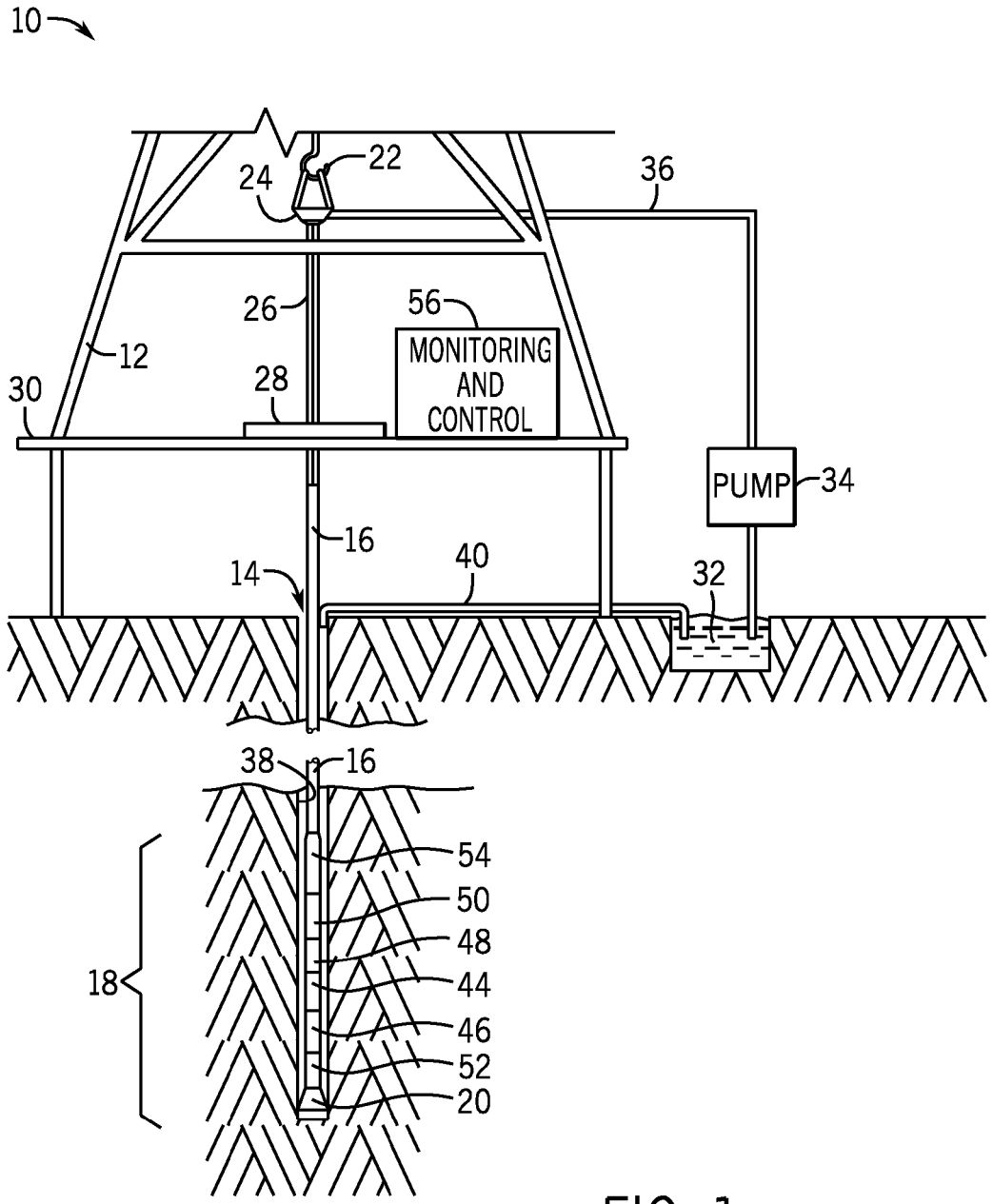
FIG. 1 generally depicts a drilling system having a fluid sampling tool in a drill string in accordance with one embodiment of the present disclosure.

Turning now to the drawings, a drilling system 10 is depicted in FIG. 1 in accordance with one embodiment. While certain elements of the drilling system 10 are depicted in this figure and generally discussed below, it will be appreciated that the drilling system 10 may include other components in addition to, or in place of, those presently illustrated and discussed. As depicted, the system 10 includes a drilling rig 12 positioned over a well 14. Although depicted as an onshore drilling system 10, it is noted that the drilling system could instead be an offshore drilling system. The drilling rig 12 supports a drill string 16 that includes a bottomhole assembly 18 having a drill bit 20. The drilling rig 12 can rotate the drill string 16 (and its drill bit 20) to drill the well 14.

The drill string 16 is suspended within the well 14 from a hook 22 of the drilling rig 12 via a swivel 24 and a kelly 26. Although not depicted in FIG. 1, the skilled artisan will appreciate that the hook 22 can be connected to a hoisting system used to raise and lower the drill string 16 within the well 14. As one example, such a hoisting system could include a crown block and a drawworks that cooperate to raise and lower a traveling block (to which the hook 22 is connected) via a hoisting line. The kelly 26 is coupled to the drill string 16, and the swivel 24 allows the kelly 26 and the drill string 16 to rotate with respect to the hook 22. In the presently illustrated embodiment, a rotary table 28 on a drill floor 30 of the drilling rig 12 is constructed to grip and turn the kelly 26 to drive rotation of the drill string 16 to drill the well 14. In other embodiments, however, a top drive system could instead be used to drive rotation of the drill string 16.

During operation, drill cuttings or other debris may collect near the bottom of the well 14. Drilling fluid 32, also referred to as drilling mud, can be circulated through the well 14 to remove this debris. The drilling fluid 32 may also clean and cool the drill bit 20 and provide positive pressure within the well 14 to inhibit formation fluids from entering the wellbore. In FIG. 1, the drilling fluid 32 is circulated through the well 14 by a pump 34. The drilling fluid 32 is pumped from a mud pit (or some other reservoir, such as a mud tank) into the drill string 16 through a supply conduit 36, the swivel 24, and the kelly 26. The drilling fluid 32 exits near the bottom of the drill string 16 (e.g., at the drill bit 20) and returns to the surface through the annulus 38 between the wellbore and the drill string 16. A return conduit 40 transmits the returning drilling fluid 32 away from the well 14. In some embodiments, the returning drilling fluid 32 is cleansed (e.g., via one or more shale shakers, desanders, or desilters) and reused in the well 14.

In addition to the drill bit 20, the bottomhole assembly 18 also includes various instruments that measure information of interest within the well 14. For example, as depicted in FIG. 1, the bottomhole assembly 18 includes a logging-while-drilling (LWD) module 44 and a measurement-while-drilling (MWD) module 46. Both modules include sensors, housed in drill collars, that collect data and enable the creation of measurement logs in real time during a drilling operation. The modules could also include memory devices for storing the measured data. The LWD module 44 includes sensors that measure various characteristics of the rock and formation fluid properties within the well 14. Data collected by the LWD module 44 could include measurements of gamma rays, resistivity, neutron porosity, formation density, sound waves, optical density, and the like. The MWD module 46 includes sensors that measure various characteristics of the bottomhole assembly 18 and the wellbore, such as orientation (azimuth and inclination) of the drill bit 20, torque, shock and vibration, the weight on the drill bit 20, and downhole temperature and pressure. The data collected by the MWD module 46 can be used to control drilling operations. The bottomhole assembly 18 can also include one or more additional modules 48, which could be LWD modules, MWD modules, or some other modules. It is noted that the bottomhole assembly 18 is modular, and that the positions and presence of particular modules of the assembly could be changed as desired. Further, as discussed in greater detail below, one or more of the modules 44, 46, and 48 could include a fluid sampling tool configured to obtain a sample of a fluid from a subterranean formation and perform downhole fluid analysis to measure properties (e.g., contamination and optical densities) of the sampled fluid.

The bottomhole assembly 18 can also include other modules. As depicted in FIG. 1 by way of example, such other modules include a power module 50, a steering module 52, and a communication module 54. In one embodiment, the power module 50 includes a generator (such as a turbine) driven by flow of drilling mud through the drill string 16. In other embodiments the power module 50 could also or instead include other forms of power storage or generation, such as batteries or fuel cells. The steering module 52 may include a rotary-steerable system that facilitates directional drilling of the well 14. The communication module 54 enables communication of data (e.g., data collected by the LWD module 44 and the MWD module 46) between the bottomhole assembly 18 and the surface. In one embodiment, the communication module 54 communicates via mud-pulse telemetry, in which the communication module 54 uses the drilling fluid 32 in the drill string as a propagation medium for a pressure wave encoding the data to be transmitted.

The drilling system 10 also includes a monitoring and control system 56. The monitoring and control system 56 can include one or more computer systems that enable monitoring and control of various components of the drilling system 10. The monitoring and control system 56 can also receive data from the bottomhole assembly 18 (e.g., data from the LWD module 44, the MWD module 46, and the additional module 48) for processing and for communication to an operator, to name just two examples. While depicted on the drill floor 30 in FIG. 1, it is noted that the monitoring and control system 56 could be positioned elsewhere, and that the system 56 could be a distributed system with elements provided at different places near or remote from the well 14.

Figure 2:
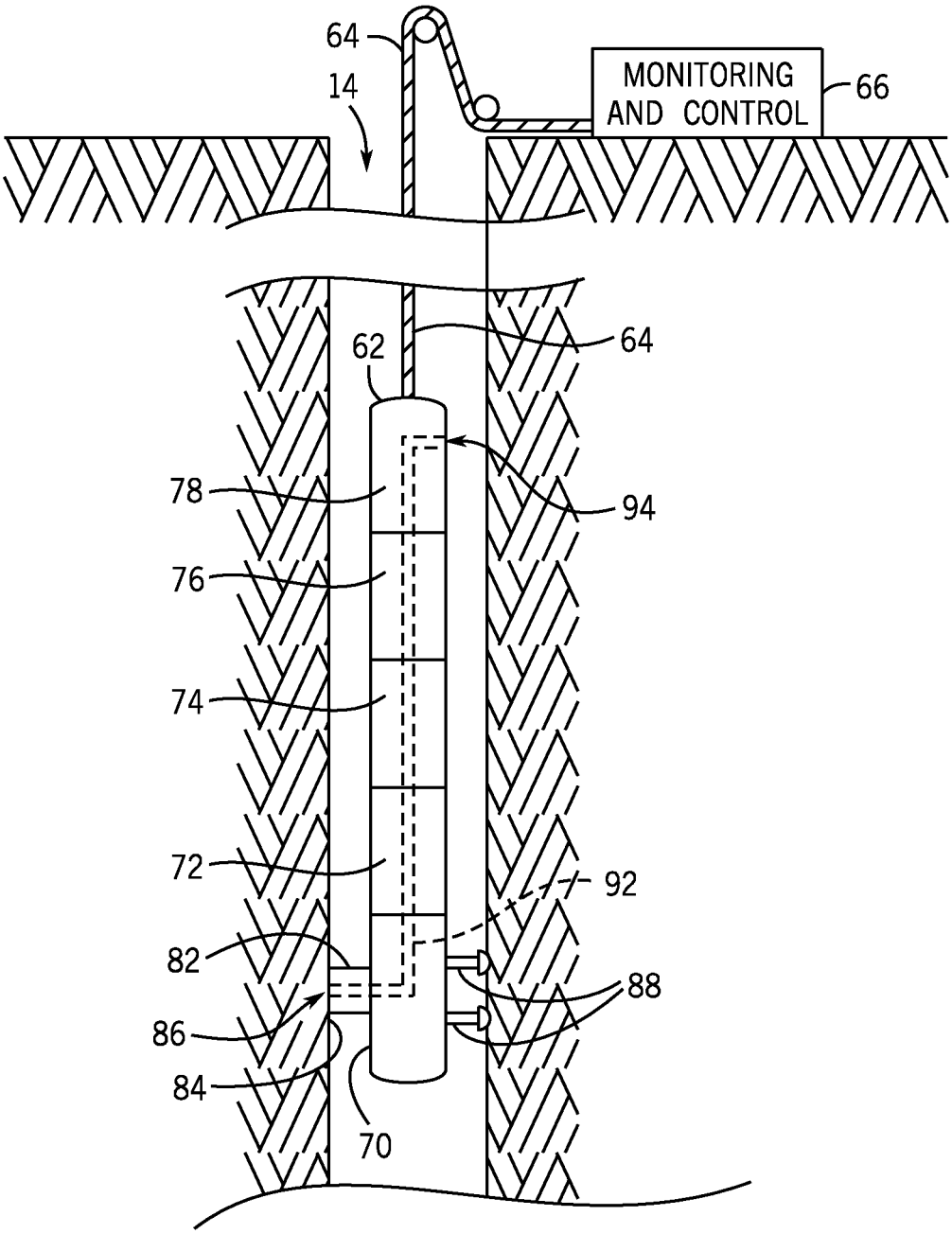
FIG. 2 generally depicts a fluid sampling tool deployed within a well on a wireline in accordance with one embodiment.

Another example of using a downhole tool for formation testing within the well 14 is depicted in FIG. 2. In this embodiment, a fluid sampling tool 62 is suspended in the well 14 on a cable 64. The cable 64 may be a wireline cable with at least one conductor that enables data transmission between the fluid sampling tool 62 and a monitoring and control system 66. The cable 64 may be raised and lowered within the well 14 in any suitable manner. For instance, the cable 64 can be reeled from a drum in a service truck, which may be a logging truck having the monitoring and control system 66. The monitoring and control system 66 controls movement of the fluid sampling tool 62 within the well 14 and receives data from the fluid sampling tool 62. In a similar fashion to the monitoring and control system 56 of FIG. 1, the monitoring and control system 66 may include one or more computer systems or devices and may be a distributed computing system. The received data can be stored, communicated to an operator, or processed, for instance. While the fluid sampling tool 62 is here depicted as being deployed by way of a wireline, in some embodiments the fluid sampling tool 62 (or at least its functionality) is incorporated into or as one or more modules of the bottomhole assembly 18, such as the LWD module 44 or the additional module 48.

The fluid sampling tool 62 can take various forms. While it is depicted in FIG. 2 as having a body including a probe module 70, a fluid analysis module 72, a pump module 74, a power module 76, and a fluid storage module 78, the fluid sampling tool 62 may include different modules in other embodiments. Further, in at least one embodiment the fluid analysis module 72 and the pump module 74 are integrated as a single module (e.g., a pump-out module with fluid analysis capabilities). The probe module 70 includes a probe 82 that may be extended (e.g., hydraulically driven) and pressed into engagement against a wall 84 of the well 14 to draw fluid from a formation into the fluid sampling tool 62 through an intake 86. As depicted, the probe module 70 also includes one or more setting pistons 88 that may be extended outwardly to engage the wall 84 and push the end face of the probe 82 against another portion of the wall 84. In some embodiments, the probe 82 includes a sealing element or packer that isolates the intake 86 from the rest of the wellbore. In other embodiments the fluid sampling tool 62 could include one or more inflatable packers that can be extended from the body of the fluid sampling tool 62 to circumferentially engage the wall 84 and isolate a region of the well 14 near the intake 86 from the rest of the wellbore. In such embodiments, the extendable probe 82 and setting pistons 88 could be omitted and the intake 86 could be provided in the body of the fluid sampling tool 62, such as in the body of a packer module housing an extendable packer.

The pump module 74 draws the sampled formation fluid into the intake 86, through a flowline 92, and then either out into the wellbore through an outlet 94 or into a storage container (e.g., a bottle within fluid storage module 78) for transport back to the surface when the fluid sampling tool 62 is removed from the well 14. The fluid analysis module 72 includes one or more sensors for measuring properties of the sampled formation fluid, such as the optical density of the fluid, and the power module 76 provides power to electronic components of the fluid sampling tool 62.

The drilling and wireline environments depicted in FIGS. 1 and 2 are examples of environments in which a fluid sampling tool may be used to facilitate analysis of a downhole fluid. The presently disclosed techniques, however, could be implemented in other environments as well. For instance, the fluid sampling tool 62 may be deployed in other manners, such as by a slickline, coiled tubing, or a pipe string.

Figure 3:
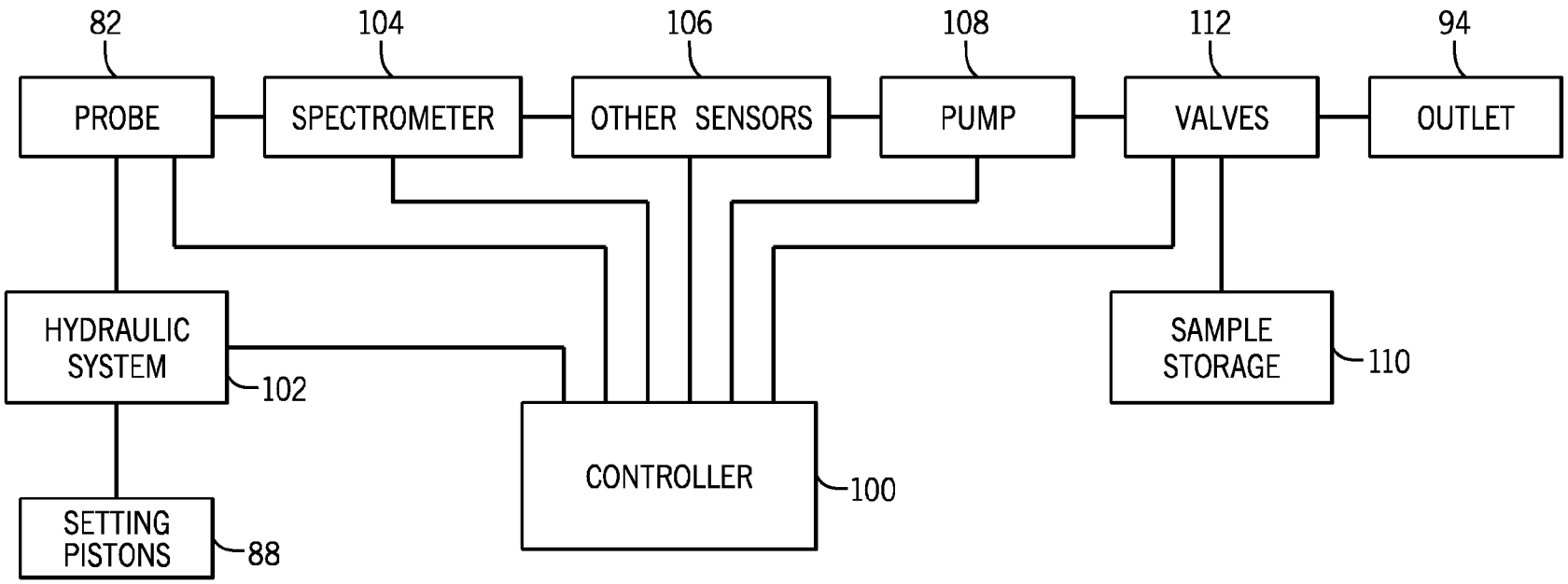
FIG. 3 is a block diagram of components of a fluid sampling tool operated by a controller in accordance with one embodiment.

Additional details as to the construction and operation of the fluid sampling tool 62 may be better understood through reference to FIG. 3. As shown in this figure, various components for carrying out functions of the fluid sampling tool 62 are connected to a controller 100. The various components include a hydraulic system 102 connected to the probe 82 and the setting pistons 88, a spectrometer 104 for measuring fluid optical properties, one or more other sensors 106, a pump 108, and valves 112 for diverting sampled fluid into storage devices 110 rather than venting it through the outlet 94.

In operation, the hydraulic system 102 extends the probe 82 and the setting pistons 88 to facilitate sampling of a formation fluid through the wall 84 of the well 14. It also retracts the probe 82 and the setting pistons 88 to facilitate subsequent movement of the fluid sampling tool 62 within the well. The spectrometer 104, which can be positioned within the fluid analysis module 72, collects data about optical properties of the sampled formation fluid. Such measured optical properties can include optical densities (absorbance) of the sampled formation fluid at different wavelengths of electromagnetic radiation. Using the optical densities, the composition of a sampled fluid (e.g., volume or weight fractions of its constituent components) can be determined. Other sensors 106 can be provided in the fluid sampling tool 62 (e.g., as part of the probe module 70 or the fluid analysis module 72) to take additional measurements related to the sampled fluid. In various embodiments, these additional measurements could include pressure and temperature, density, viscosity, electrical resistivity, saturation pressure, and fluorescence, to name several examples. Other characteristics, such as gas-oil ratio (GOR), can also be determined using the measurements.

Any suitable pump 108 may be provided in the pump module 74 to enable formation fluid to be drawn into and pumped through the flowline 92 in the manner discussed above. Storage devices 110 for formation fluid samples can include any suitable vessels (e.g., bottles) for retaining and transporting desired samples within the fluid sampling tool 62 to the surface. The storage devices 110 may be provided in the fluid storage module 78. Valves 112 for selectively diverting formation fluid to the storage devices 110 can be located in the fluid storage module 78 or in some other module (e.g., the pump module 74). It will be appreciated that the tool 62 could include other valves, such as valves operated to control formation fluid intake and routing through the tool.

In the embodiment depicted in FIG. 3, the controller 100 facilitates operation of the fluid sampling tool 62 by controlling various components. Specifically, the controller 100 directs operation (e.g., by sending command signals) of the hydraulic system 102 to extend and retract the probe 82 and the setting pistons 88 and of the pump 108 to draw formation fluid samples into and through the fluid sampling tool. The controller 100 also receives data from the spectrometer 104 and the other sensors 106. This data can be stored by the controller 100 or communicated to another system (e.g., the monitoring and control system 56 or 66) for analysis. In some embodiments, the controller 100 is itself capable of analyzing the data it receives from the spectrometer 104 and the other sensors 106. The controller 100 also operates the valves 112 to divert sampled fluids from the flowline 92 into the storage devices 110. For example, the controller 100 can determine filtrate contamination levels of a sampled formation fluid in the tool 62 (e.g., using data from one or more spectrometers 104) during an initial clean-up phase, and then operate a valve 112 to divert the formation fluid into a storage device 110 when the determined contamination level falls to a desired level.

Figure 4:
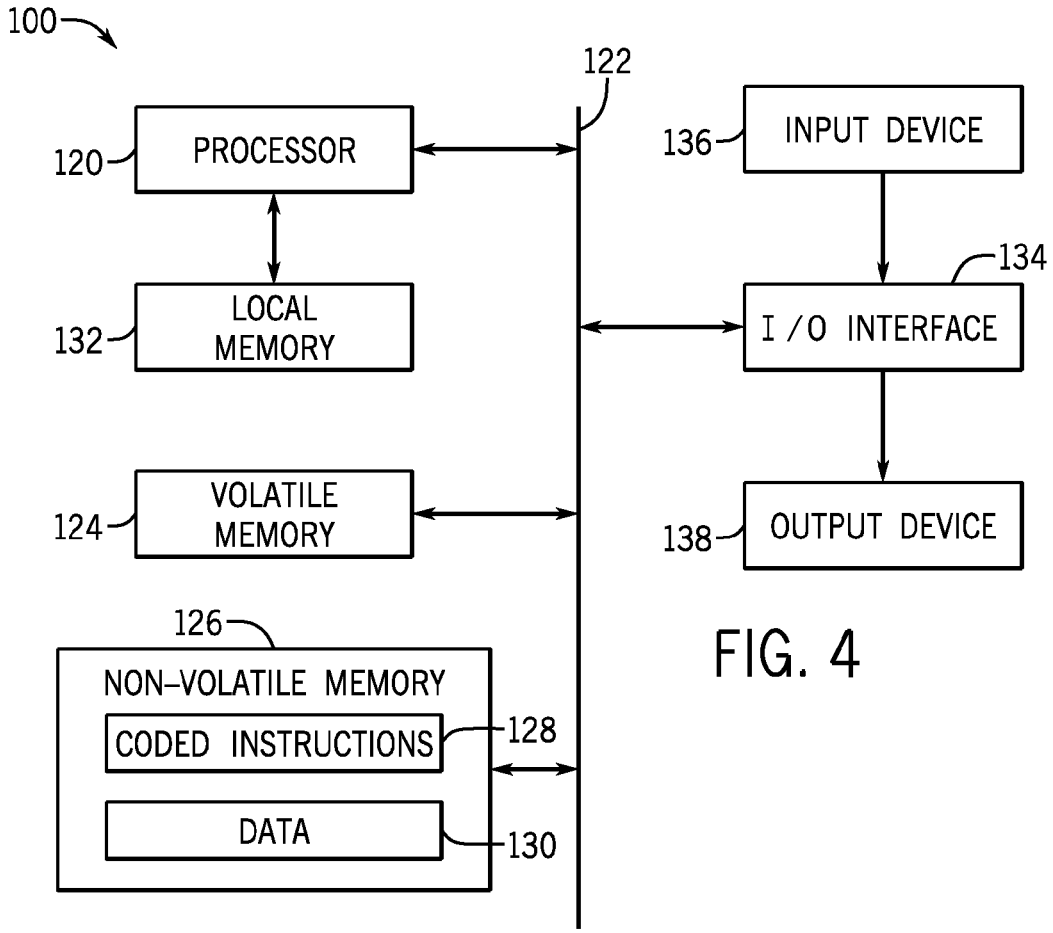
FIG. 4 is a block diagram of components in one example of the controller illustrated in FIG. 3.

The controller 100 in some embodiments is a processor-based system, an example of which is provided in FIG. 4. In this depicted embodiment, the controller 100 includes at least one processor 120 connected, by a bus 122, to volatile memory 124 (e.g., random-access memory) and non-volatile memory 126 (e.g., flash memory and a read-only memory (ROM)). Coded application instructions 128 (e.g., software that may be executed by the processor 120 to enable the control, analysis, compression, and transmission functionality described herein) and data 130 are stored in the non-volatile memory 126. For example, the application instructions 128 can be stored in a ROM and the data can be stored in a flash memory. The instructions 128 and the data 130 may be also be loaded into the volatile memory 124 (or in a local memory 132 of the processor) as desired, such as to reduce latency and increase operating efficiency of the controller 100.

An interface 134 of the controller 100 enables communication between the processor 120 and various input devices 136 and output devices 138. The interface 134 can include any suitable device that enables such communication, such as a modem or a serial port. In some embodiments, the input devices 136 include one or more sensing components of the fluid sampling tool 62 (e.g., the spectrometer 104 and other sensors 106) and the output devices 138 include a mud-pulse generator of the communications module 54, displays, printers, and storage devices that allow output of data received or generated by the controller 100. Input devices 136 and output devices 138 may be provided as part of the controller 100, although in other instances such devices may be separately provided.

The controller 100 can be provided as part of the monitoring and control systems 56 or 66 outside of a well 14 to enable downhole fluid analysis of samples obtained by the fluid sampling tool 62. In such embodiments, data collected by the fluid sampling tool 62 can be transmitted from the well 14 to the surface for analysis by the controller 100. In some other embodiments, the controller 100 is instead provided within a downhole tool in the well 14, such as within the fluid sampling tool 62 or in another component of the bottomhole assembly 18, to enable downhole fluid analysis to be performed within the well 14. Further, the controller 100 may be a distributed system with some components located in a downhole tool and others provided elsewhere (e.g., at the surface of the wellsite).

Whether provided within or outside the well 14, the controller 100 can receive data collected by the sensors within the fluid sampling tool 62 and process this data to determine one or more characteristics of the sampled fluid. Examples of such characteristics include fluid type, GOR, carbon dioxide content, water content, and contamination level.

Some of the data collected by the fluid sampling tool 62 is optical spectrum data relating to optical properties (e.g., optical densities) of a sampled fluid measured by the spectrometer 104. To facilitate measurement, in some embodiments the spectrometer 104 may be arranged about the flowline 92 of the fluid sampling tool 62 in the manner generally depicted in FIG. 5. In this example, the spectrometer 104 includes an emitter 142 of electromagnetic radiation, such as a light source, and a detector 144 disposed about the flowline 92 in the fluid sampling tool 62. A light source provided as the emitter 142 can be any suitable light-emitting device, such as one or more light-emitting diodes or incandescent lamps. As used herein, the term "visible light" is intended to mean electromagnetic radiation within the visible spectrum, and the shorter term "light" is intended to include not just electromagnetic radiation within the visible spectrum, but also infrared and ultraviolet radiation.

Figure 5:
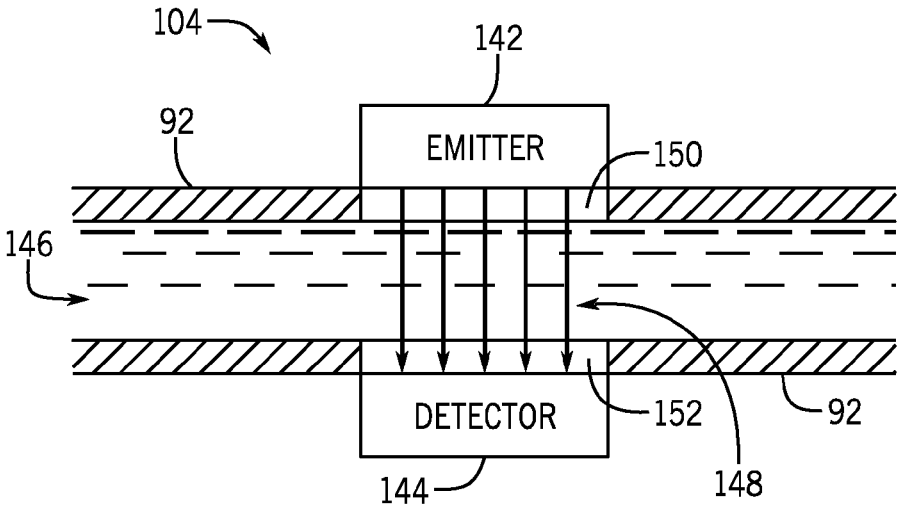
FIG. 5 generally depicts a spectrometer positioned about a flowline to enable measurement of an optical property of a fluid within the flowline in accordance with one embodiment.

In operation, a sampled formation fluid 146 within the flowline 92 is irradiated with electromagnetic radiation 148 (e.g., light) from the emitter 142. The electromagnetic radiation 148 includes radiation of any desired wavelengths within the electromagnetic spectrum. In some embodiments, the electromagnetic radiation 148 has a continuous spectrum within one or both of the visible range and the short- and near-infrared (SNIR) range of the electromagnetic spectrum, and the detector 144 filters or diffracts the received electromagnetic radiation 148. The detector 144 may include a plurality of detectors each assigned to separately measure light of a different wavelength. As depicted in FIG. 5, the flowline 92 includes windows 150 and 152 (e.g., sapphire windows) that isolate the emitter 142 and the detector 144 from the sampled formation fluid 146 while still permitting the electromagnetic radiation 148 to be transmitted and measured. As will be appreciated, some portion of the electromagnetic radiation 148 is absorbed by the sampled fluid 146, and the extent of such absorption varies for different wavelengths and sampled fluids. The optical density of the fluid 146 at one or more wavelengths may be determined based on data from the spectrometer 104 by comparing the amount of radiation emitted by the emitter 142 and the amount of that radiation received at detector 144. It will be appreciated that the optical density (also referred to as the absorbance) of a fluid at a given wavelength is calculated as the base-ten logarithm of the ratio of electromagnetic radiation incident on the fluid to that transmitted through the fluid for the given wavelength.

The spectrometer 104 may include any suitable number of measurement channels for detecting different wavelengths, and may include a filter-array spectrometer or a grating spectrometer. For example, in some embodiments the spectrometer 104 is a filter-array absorption spectrometer having sixteen measurement channels. In other embodiments, the spectrometer 104 may have ten channels or twenty channels, and may be provided as a filter-array spectrometer or a grating spectrometer. Further, as noted above, the data obtained with the spectrometer 104 can be used to determine optical densities of sampled fluids at the detected wavelengths.

Various data may be transmitted from a downhole tool to the surface. This data may include measurements related to the formation fluid sampled by the tool, such as optical spectrum data acquired with one or more spectrometers 104 and other data acquired with the other sensors 106. The transmitted data can also include additional data that is generated from the acquired data, such as GOR, optical density ratio, oil and water fractions, and fluid composition measurements calculated from the acquired optical spectrum data. In many instances, it is useful for surface operators to understand properties (e.g., contamination level or composition) of fluid sampled by the downhole tool.

The data transmitted from the downhole sampling tool to the surface may be communicated in any suitable manner. When the downhole sampling tool is provided as part of a drill string, for instance, data may be transmitted from the tool to the surface via mud-pulse telemetry, as noted above. The rate at which mud-pulse telemetry can transmit data varies depending on implementation details and environment. In some instances, such as deep-water environments or when using oil-based mud, the telemetry speed can be less than 3.0 bits per second (bps). Data compression can be used to reduce the number of bits to be communicated from a downhole tool, thus facilitating data transmission via mud-pulse telemetry.

Figure 6:
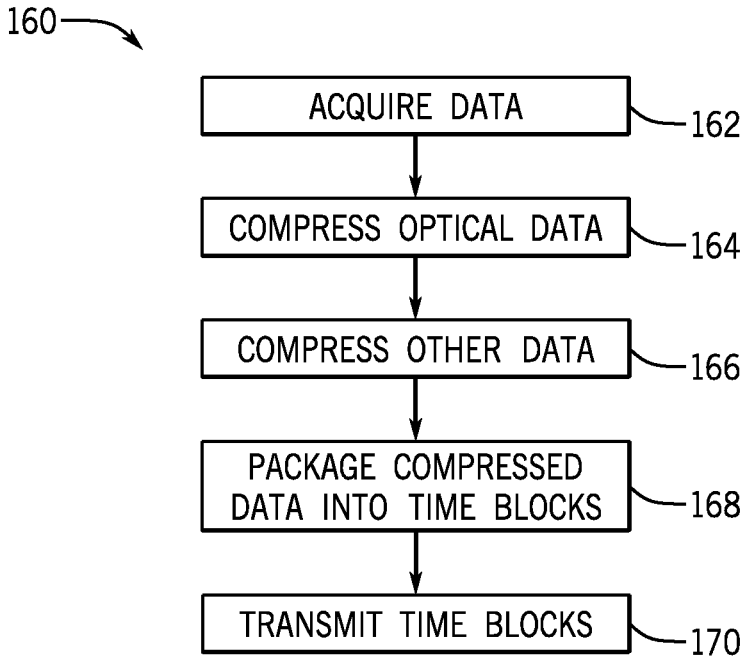
FIG. 6 is a flowchart for transmitting compressed fluid data, such as from a downhole tool to the surface, in accordance with one embodiment.

By way of example, a method for transmitting compressed data (e.g., fluid measurements) is generally represented by flowchart 160 in FIG. 6. Although this method may be used for transmitting fluid data from a downhole tool to the surface via mud-pulse telemetry, it will be appreciated that this technique could also be used for transmitting compressed data in other systems. As shown in FIG. 6, the method includes acquiring data (block 162). The acquired data includes optical data and non-optical data. By way of example, the acquired data may include optical spectrum data for a formation fluid sampled by a downhole tool (e.g., optical density measurements), as well as other (i.e., non-optical) data for the sampled formation fluid, obtained via downhole fluid analysis.

The optical data and the other data are compressed (blocks 164 and 166) and then packaged together (block 168) into time blocks. Once packaged, the time blocks of compressed data may be transmitted (block 170). In one embodiment, the transmitted time blocks are received at a surface installation (e.g., a drilling rig) via mud-pulse telemetry from a downhole tool. The compressed data in the received time blocks can be decompressed and used to inform decision-making processes. For instance, the data packaged in the time blocks can be received and then decoded at the surface for computing fluid contamination and deciding whether to capture the sampled fluid in a storage device 110 of the tool.

The downhole fluid sampling tool 62 can acquire measurements for various data channels, as generally described above. These data channels can include optical spectrum data for the sampled formation fluid. In at least some embodiments, these optical data channels include measurements of optical density for each wavelength measurement channel of the spectrometer 104 (e.g., for twenty different wavelengths in a twenty-channel spectrometer). The data channels can also include a variety of non-optical data measured with other sensors, such as flow rate through the flowline 92, inlet and outlet pressures of the flowline 92, fluid temperature, fluid resistivity, and accumulated fluid volume pumped through the flowline 92 (e.g., at a given measurement station in the well). The fluid sampling tool 62 can also have additional data channels with measurements computed from the data acquired with tool sensors. For example, the optical spectrum data acquired with the spectrometer 104 can be used to calculate GOR, optical density ratio, oil fraction, water fraction, and fluid composition (e.g., weight percentages of C1, C2, C3-C5, C6+, and CO2). In some instances, measurement uncertainties (e.g., error bars) can also be estimated for calculated values, such as for the GOR and fluid composition calculations.

Although measurements for each wavelength channel of a spectrometer may be transmitted to the surface in some instances, in other cases measured data is transmitted (e.g., with mud-pulse telemetry via communication module 54) from the tool to the surface for just some of the optical data channels. In one embodiment, for example, just six wavelength channels of a twenty-channel spectrometer are transmitted. The optical data channels to be transmitted can be selected in any suitable manner, such as based on the expected formation fluid composition. When each of the optical data channels is transmitted to the surface, the fluid composition calculations may be made at the surface based on the received optical data channels and transmission of the composition channels from the tool may be omitted. In other instances in which just some of the optical data channels are transmitted, however, the received optical data channels may not be sufficient to accurately calculate the fluid composition. In such cases, the composition channels can be calculated by the downhole tool and then transmitted to the surface.

In some instances, the various data channels may be sorted into categories according to update priority (e.g., based on the largest desired sample spacing between consecutive samples of each channel). For example, those channels having measurements with a lower desired maximum update period may be classified as "fast channels" (e.g., an update period less than sixty seconds) and those channels having measurements with a higher desired maximum update period classified as "slow channels" (e.g., an update period between three to five minutes). In at least one embodiment, the channels are categorized as "fast" or "slow" to optimize real-time decision-making (e.g., regarding sample capture based on downhole fluid analysis). Though the fast channels can be tolerated at the minimum update rate (e.g., sixty seconds per sample), in some instances it may be desirable for the fast channels to be updated at a faster rate (e.g., thirty seconds or less per sample). In at least one embodiment, the fast channels include the channels for optical data, accumulated fluid volume, flow rate, inlet pressure, outlet pressure, resistivity, temperature, GOR, optical density ratio, oil fraction, and water fraction, while the slow channels include the channels for fluid composition (e.g., a channel for each of C1, C2, C3-C5, C6+, and CO2 by weight percentage) and for estimated measurement uncertainties (e.g., error bars for the fluid composition measurements and the GOR calculation).

Figure 7:
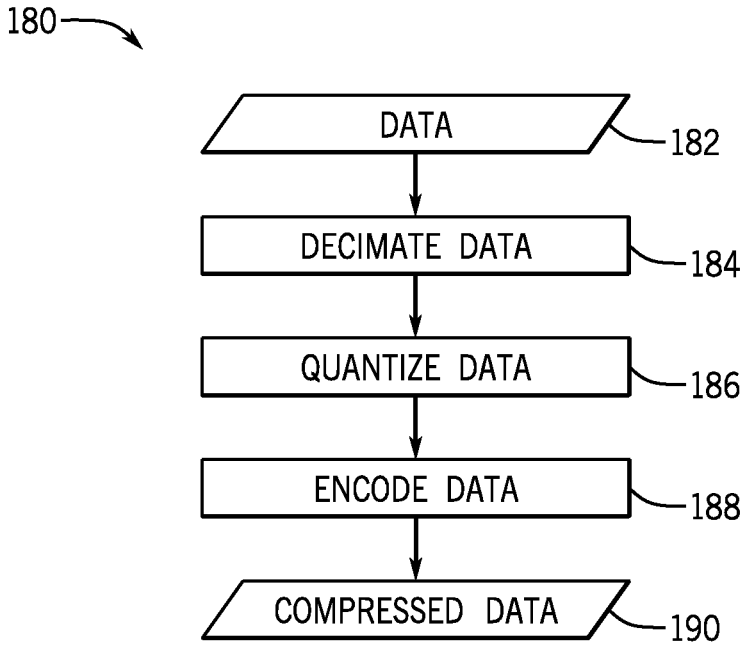
FIG. 7 is a flowchart for compressing data, such as fluid data acquired with a downhole tool, in accordance with one embodiment.

Any suitable compression techniques may be used to compress data acquired with the fluid sampling tool 62 to facilitate transmission of data to the surface. While pumping formation fluids into the flowline and taking measurements, the tool may accumulate the measured data for each channel at a desired sampling rate (e.g., 1 Hz). The accumulated data may be divided into time blocks for compression and transmitted in these blocks in real time. A data buffer (e.g., in the memory 126) may be designated for each of the fast channels to accumulate measurements for a new time block of data while a previous time block (or other measurements) is being transmitted to the surface. In one embodiment, the data buffer is sized to hold 1024 samples of each measured channel, which allows the buffer to hold up to 1024 seconds of the most-recent data sampled at the rate of 1 Hz. Different compression techniques can be used for compressing the different types of channels, but generally speaking, for a given time block, data may be compressed using the different compression techniques according to a method generally represented by flowchart 180 in FIG. 7. More particularly, data 182 from the channels may be decimated (block 184), quantized (block 186), and then encoded (block 188) according to any desired compression schemes to produce a compressed data set 190. In at least some embodiments the encoding of the data is lossless.

Compression can begin when the tool 62 receives a request for a new block of data. In some embodiments, such a request is made shortly before or after a previous block of data has been transmitted (e.g., by the communication module 54) for efficient utilization of the communication link between the downhole tool and the surface. Those skilled in the art will appreciate that any suitable compression methods may be used to compress the data. Further, multiple compression methods may be used by the tool 62 to compress the different types of the measurements.

Decimation (block 184) includes reducing the size of the data to be transmitted to the surface in a given time block. The decimation may be performed in any suitable manner, such as by sampling the measured data acquired over the elapsed time covered by the new time block of data (e.g., the data acquired since compression of the previous block and held in the data buffer noted above). In one embodiment, during decimation, five samples per channel are taken from the data acquired during the elapsed time for the fast channels (e.g., optical data channels) and one sample per channel is taken from the data acquired during the elapsed time for the slow channels (e.g., the fluid composition channels). For example, if a fluid sampling tool 62 collects data for the channels over a 200-second period, decimation can include sampling the fast channels at 40-second intervals (for a total of five samples in the elapsed time) and taking a single sample for each slow channel (e.g., at the midpoint or the end of the 200-second period). In some instances, filters or averaging may be used to smooth the acquired data and reduce outliers in the samples taken during decimation. The raw data block length (i.e., the time length in seconds of the accumulated data) may be transmitted so that the time stamps for the decimated samples can be recovered accurately at the surface.

Quantization (block 186) may applied to the decimated samples with predefined accuracy tolerances, and one example of this quantization with respect to optical data channels is discussed in greater detail below. The quantized data may be encoded (block 188) with a combination of many kinds of encoders, such as a Huffman coder, a run-length coder, delta coders, signed and unsigned-magnitude coders, predictive coders, and so forth. In some cases, each compression algorithm runs multiple encoders in parallel and the resulting bit packet with the fewest bits is selected for transmission. An example of such an encoding process is also discussed in greater detail below with respect to optical data channels.

Figure 8:
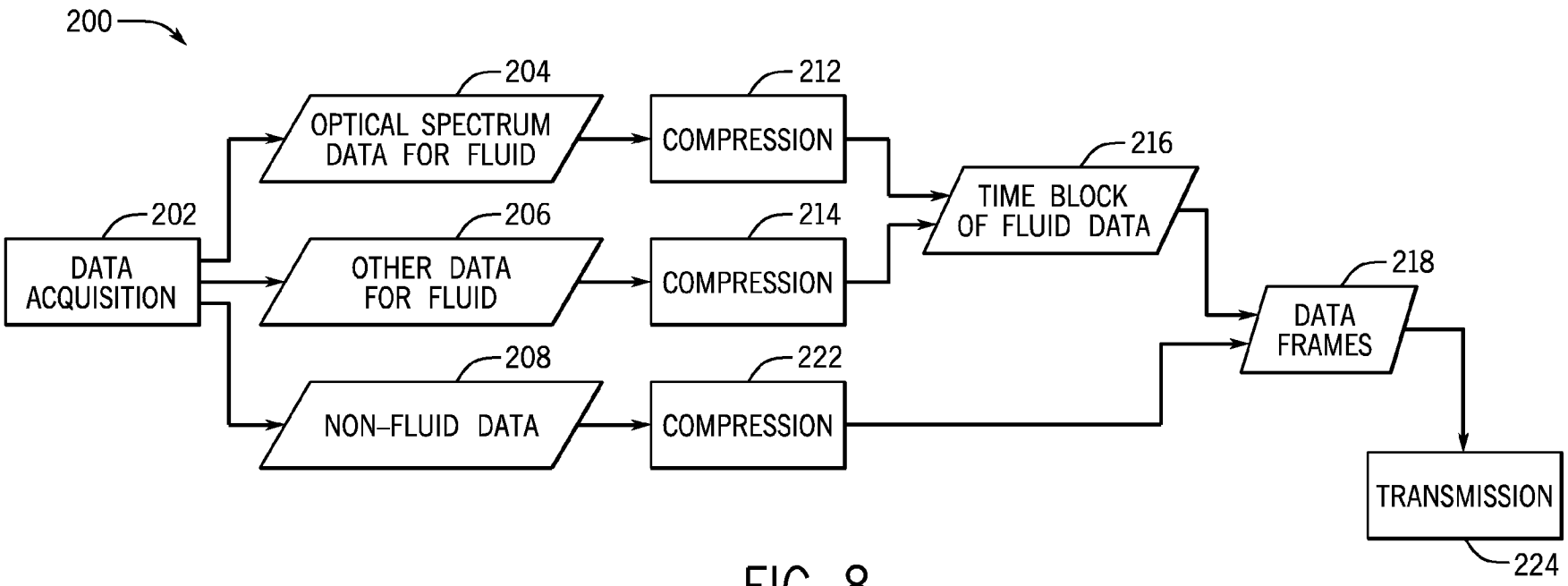
FIG. 8 is a block diagram generally representing the compression and packaging of various data acquired with a downhole tool into time blocks and data frames for transmission in accordance with one embodiment.

As noted above, both optical data and non-optical data for a sampled formation fluid may be compressed and packaged together in a shared time block. Further, the time block having the compressed fluid data may also be incorporated into one or more data frames having non-fluid data, as indicated in block diagram 200 of FIG. 8. As generally shown in this figure, downhole data acquisition 202 over an elapsed time may produce optical spectrum data 204 for the sampled formation fluid, other (non-optical) data 206 for the formation fluid (such as the non-optical data channels discussed above), and various other, non-fluid data 208. The non-fluid data 208 may include information about tool operational status, drill bit position and orientation, tool calibration results, or the occurrence of events of interest, for example.

When a new block of data is to be transmitted to the surface, the optical spectrum data 204 and the other fluid data 206 can be compressed (blocks 212 and 214) and packaged together into a time block 216 of fluid data. In at least some instances, the optical spectrum data 204 is compressed according to one compression technique and the other fluid data 206 is compressed according to one or more additional compression techniques. The data 204 and 206 comes from various data channels, which may be categorized as fast channels or slow channels as described above. In at least some embodiments, the compression of the data 204 and 206 includes decimation in which the fast channels are sampled at a greater rate than the slow channels and, consequently, data samples from the fast channels are included in the time block more frequently than are data samples from the slow channels.

Based on the type of measurements, some data channels may be compressed together as a group to improve efficiency, while other data channels may be compressed individually. As used herein, compression of data channels as a group means compression of data from multiple data channels such that the compression of data from at least one of the channels of the group depends on the compression of data from at least one other channel of the group. In some embodiments, the optical data channels (providing the optical spectrum data 204) are compressed together in one group and packaged with other compressed data (e.g., other fluid data 206) into the time blocks 216. The compressed bits from both the optical and non-optical data channels may be packed together for transmission, along with error correction codes (e.g., product single parity check codes) appended at the end of the bit packet to fix possible errors introduced by telemetry noise. The resulting bit package, whose size varies from one time block of data to another as a result of the use of variable-length coding schemes, may be segmented into a series of smaller portions (e.g., 8-bit, 12-bit, or 16-bit portions) for processing and transmission.

The time block 216 of fluid data can be packaged as part of larger data frames 218 including non-fluid data 208. The non-fluid data 208 can be compressed (block 222) prior to inclusion in the data frame 218 or left uncompressed. Further, the data frames 218 can be transmitted (block 224) to the surface in any suitable manner, such as via mud-pulse telemetry. In some instances, each data frame 218 may have a predetermined size (e.g., 100 bits or 200 bits) with some portion of the frame 218 (e.g., twenty-five bits or fifty bits) allocated to fluid data packaged in time blocks 216. A single time block 216 of compressed fluid data may have more or fewer bits than the space allocated for fluid data in a single data frame 218. Consequently, the bit string of a single time block 216 may span multiple data frames 218 or may fit entirely within a single data frame 218 with room to spare. A header (e.g., an assigned 8-bit or 12-bit code) may be used to indicate time block boundaries, with the header signaling the end of one time block and the beginning of another. This facilitates efficient transmission by allowing new time blocks of fluid data to commence at any desired position within the space allocated to fluid data in a data frame 218.

In at least some embodiments optical density channels of the spectrometer 104 are grouped together for compression so as to achieve better compression efficiency by taking advantages of the relationships among the data to be compressed. The relationships among optical density data normally lie in two aspects: 1) data samples from different channels taken at the same time are correlated because the spectrum is determined by the composition of the fluid in the flowline, and 2) data from the same channel often changes continuously in time.

Compression of data of the optical density channels may include decimation, such as described above, as well as quantization and encoding. During the quantization process of one embodiment, the decimated samples of each of the optical density channels may be confined to a range of [−0.5, 3.5], although a different range could be used in other instances. The data outside the range may be truncated to the closest endpoint of the range (i.e., at −0.5 or 3.5 in the present example). Each sample may then be linearly quantized into an integer inside the range of [0, 400] by the following:

$$q=\text{round}[100(x+0.5)] \quad \text{(Eq. 1)}$$

Such quantization gives a uniform distributed error within ±0.005. In the case of a twenty-channel spectrometer 104 and decimation of the acquired optical density data to five samples per channel for a given time block, quantization of the post-decimation samples in the manner described above provides one hundred integers representative of the optical density of the analyzed fluid (for twenty different wavelengths channels and at five different times for each wavelength channel). The number of wavelength channels (N) to be transmitted may be programmable by the user in certain embodiments, and in at least one embodiment $N \in [6, 20]$.

As noted above, the quantized data to be transmitted can be encoded in any suitable manner. In some embodiments, the optical density data is compressed using one or more of a variety of encoders. For example, the optical density data can be compressed using a delta-lambda ($\Delta\lambda$) encoder (e.g., for encoding differences between measurements of adjacent wavelength channels) or a delta-time ($\Delta t$) encoder (e.g., for encoding differences between measurements within each channel at different times). Another example is a spectrum peak encoder, in which measured data can be compared to known spectra for different fluid types, expected values may be predicted from one of the known spectra, and prediction errors between the expected and measured values can be encoded. Further, the optical density data could be encoded with a spectrum array encoder, in which one channel is selected as a reference channel and the measurements of the other channels are encoded with respect to the reference channel using a spectrum peak encoder or a delta-lambda encoder. Various other predictive coders and single-channel coders may also be used in some instances.

The effectiveness of various compression techniques will depend on the data, and the optimal compression technique may vary from case to case. In some embodiments, when a new time block of data is requested, the optical density data (or other optical data) is compressed with each of several different compression techniques to facilitate selection of the resulting compressed data set with the smallest number of bits. One example of this is generally represented by flowchart 230 in FIG. 9, in which optical data 234 is acquired (block 232) and then compressed according to different compression techniques. The optical data 234 (e.g., optical density data) can be compressed as a group with each of four different compression techniques (blocks 236, 238, 240, and 242) independent of one another to produce compressed data sets 246, 248, 250, and 252. Although each of the compressed data sets 246, 248, 250, and 252 is based on the optical data 234, these compressed data sets may differ in the number of bits used. The resulting compressed data sets 246, 248, 250, and 252 may be compared (block 254) and one of these compressed data sets may be selected (block 256) for transmission. In at least one embodiment, the compressed data set with the fewest bits is selected for transmission, although other selection criteria could be used if desired. The selected compressed data set can be packaged in a time block and transmitted to the surface, as discussed above.

Figure 9:
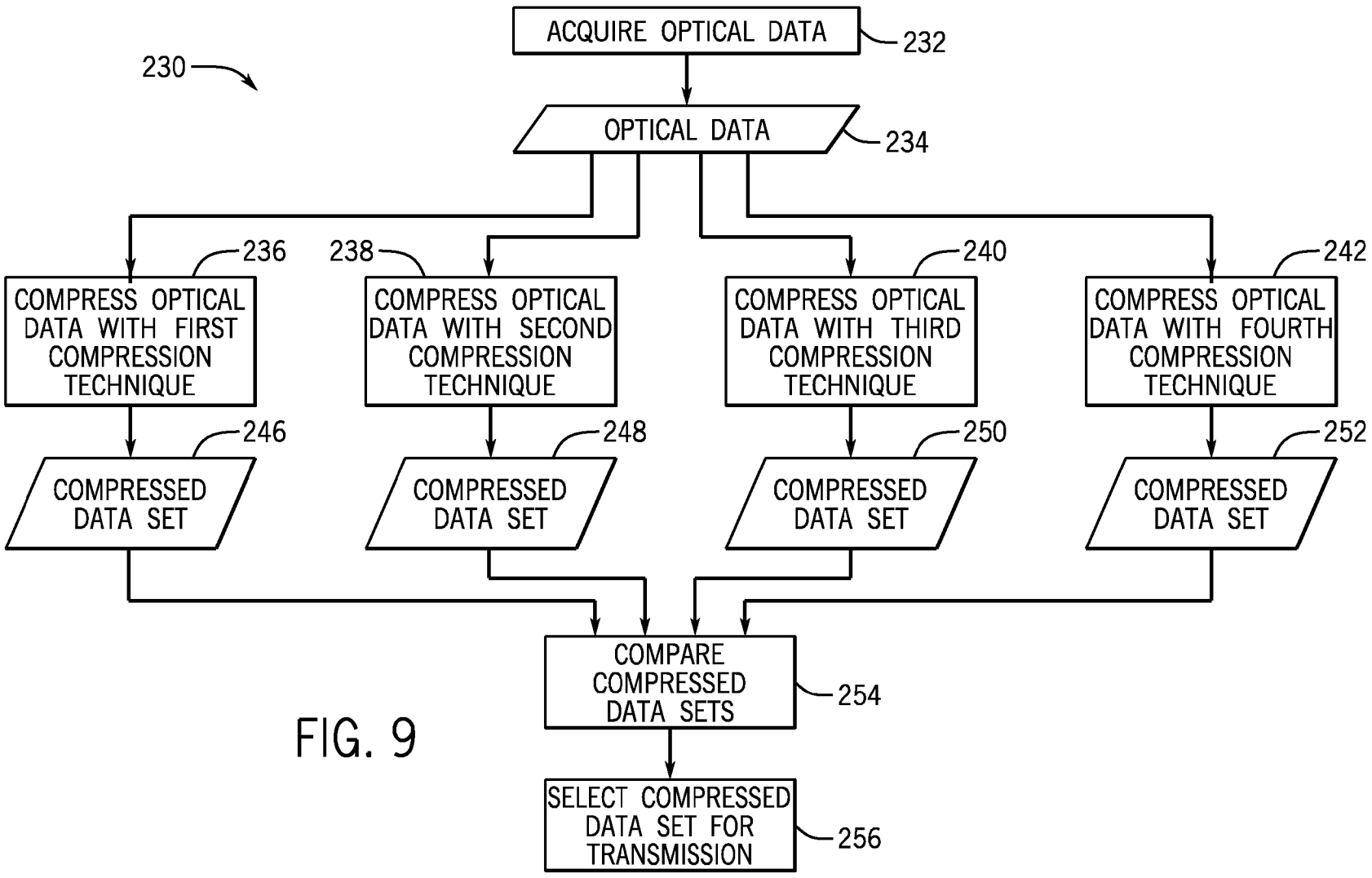
FIG. 9 is a flowchart for separately compressing optical data according to multiple compression techniques to produce multiple compressed data sets and for selecting one of the compressed data sets for transmission in accordance with one embodiment.

Although compression of the optical data with four different compression techniques is depicted in FIG. 9, it will be appreciated that some other number of compression techniques could be used and compared to select a compressed data set for transmission. In at least some embodiments, the different compression techniques include the same decimation and quantization, but differ in their encoding. Regardless of the number of different compression techniques, any suitable compression techniques could be used independent of one another to separately compress the optical data, and the technique that yields the least number of output bits may be selected for transmission.

The downhole tool may be configurable to transmit fluid data from the data channels in accordance with different transmission modes. In some instances, the downhole tool can be programmed to compress acquired fluid data into different types of time blocks and transmit the time blocks according to selectable transmission modes, such as the transmission modes generally represented in FIG. 10. The time block types in FIG. 10 may differ in any desired way, but in at least some embodiments the block types differ with respect to the data channels included in the block type.

By way of further example, in certain embodiments two configuration options may be provided to facilitate transmission based on the job condition and specifications. The configurations can be programmed into the downhole tool prior to deployment in a well, and the configuration to be used may be chosen before deployment or while the tool is in a well. The first configuration option includes sending the full spectrum of optical density (OD) channels, along with other fast channels measured firsthand by the downhole tool independent of the OD channels (e.g., accumulated fluid volume, flow rate, inlet pressure, outlet pressure, resistivity, and temperature), and then calculating at the surface the channels that are derivable from the sent optical density channels (e.g., GOR, optical density ratio, oil fraction, water fraction, and fluid composition). This may yield a good compression ratio because OD samples are highly correlated, and in this option the composition channels are given at a much faster sampling rate (as they can be calculated at the surface from the transmitted OD channels). A tradeoff is that one compression block may contain too many bits, resulting in longer transmission delay.

The second configuration option includes computing the OD-derivable channels downhole (e.g., based on the full spectrum of OD channels) and transmitting these computed channels along with a proper subset of the OD channels (i.e., fewer than the entire set of OD channels, such as six OD channels of a twenty-channel spectrometer) and with the other fast channels measured by the tool independent of the OD channels. In this option, the fast channels (including the selected OD channels, rather than the full set of OD channels) may be sent at a faster update rate and the slow channels (e.g., the downhole-computed fluid composition channels and measurement uncertainty channels) may be sent at a slower update rate. A compressed block under this second option may contain fewer bits than would be the case under the first option. The results of this second option may differ from those of the first option in often providing a compressed block with fewer bits and smaller transmission latency, with tradeoffs of a slower update rate for the composition channels and a lower compression ratio.

Figure 10:
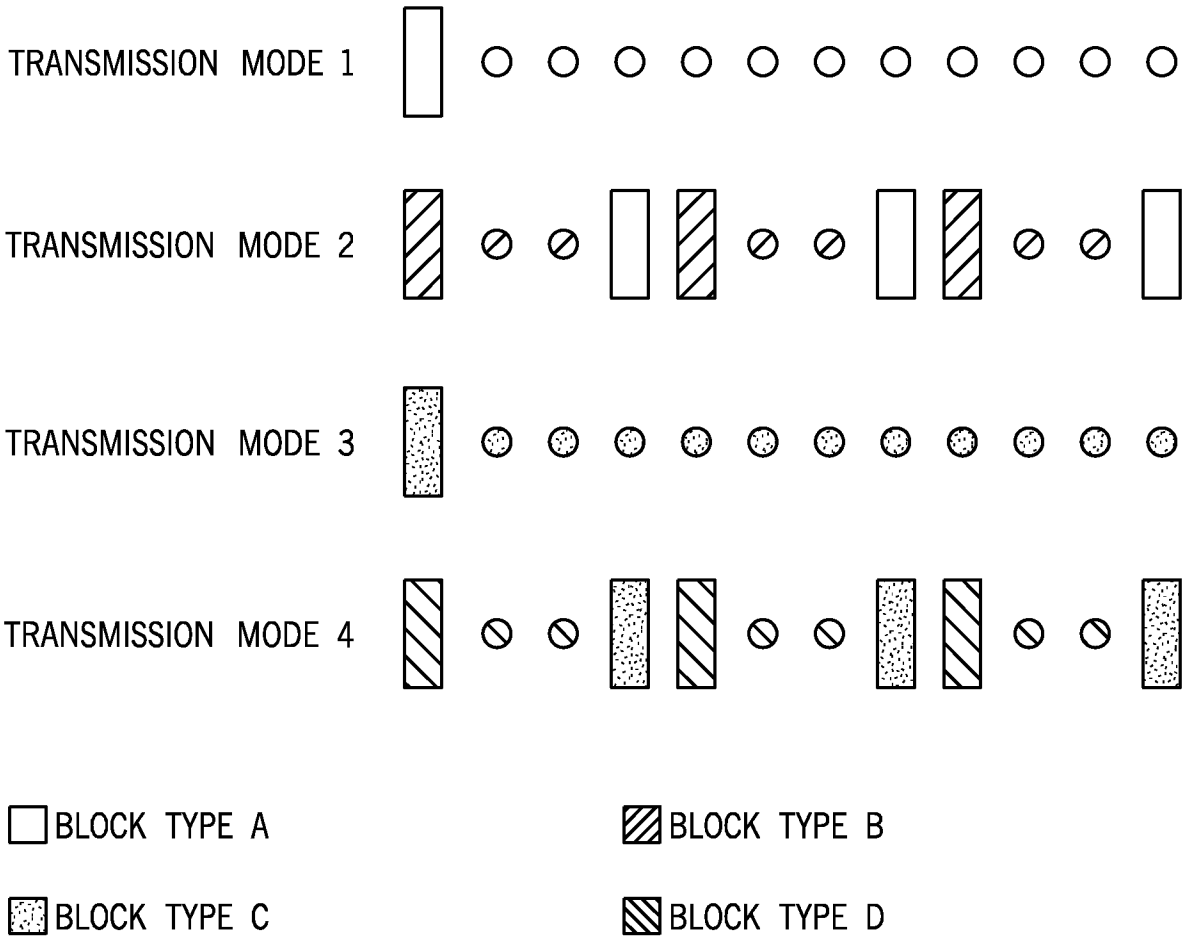
FIG. 10 depicts various transmission modes available for transmitting a series of time blocks of compressed data in accordance with one embodiment.

In some embodiments, these two configuration options are accomplished by packaging and transmitting series of time blocks of compressed data in accordance with the four transmission modes depicted in FIG. 10. For instance, block types A and B of FIG. 10 can include full spectrum optical data (i.e., compressed data for each of the optical data channels), while block types C and D can include optical data for just a part of the spectrum (i.e., compressed data from a proper subset of the optical data channels). Further, block types A and C can be "slow blocks" that include data from both fast channels and slow channels, while block types B and D can be "fast blocks" that include data solely from fast channels without any slow channel data. The time blocks of compressed data in FIG. 10 can be created on demand by the tool (such as upon request, as discussed above) and can vary in bit length.

In one embodiment, each of the type-A time blocks is a slow block including data for fast channels (specifically, the full spectrum of OD channels, along with other desired fast channels measured firsthand by the downhole tool independent of the OD channels) and for slow channels that may not be derivable from the transmitted OD channels (specifically, the measurement uncertainty channels). The type-A time blocks may exclude data from fast and slow channels that can be derived from the transmitted OD-channel data at the surface. Further, each of the type-B time blocks is a fast block including data for at least some of the fast channels included in block type A (i.e., the full spectrum of OD channels and other desired fast channels measured firsthand by the downhole tool independent of the optical density channels), but without the slow channels included in block type A. That is, block type B may be a streamlined version of block type A in which the slow channels from block type A have been omitted.

Still further, each of the type-C time blocks of the same embodiment is a slow block including data for fast channels (specifically, a proper subset of the OD channels (fewer than in the type-A time block), along with other desired fast channels measured firsthand by the downhole tool independent of the OD channels, as well as other fast channels computed downhole based on the OD channels) and for slow channels that may not be derivable from the transmitted OD channels (specifically, the measurement uncertainty channels and fluid composition channels computed downhole from a larger number of OD channels than are to be transmitted to the surface). Additionally, each of the type-D time blocks in this embodiment is a fast block including data for at least some of the fast channels included in block type C, but without the slow channels included in block type C. That is, similar to the relationship between block types B and A, block type D may be a streamlined version of block type C in which the slow channels from block type C have been omitted.

In the first transmission mode of FIG. 10, the downhole tool packages and transmits the fluid data in a series of slow type-A time blocks uninterrupted by other time block types. When the data for each time block was previously decimated by sampling the fast channels five times per block and the slow channels one time per block, including both the fast and slow channels in each time block results in the fast channels having an update rate five times that of the slow channels over the sequence of time blocks.

In the second transmission mode of FIG. 10, however, the downhole tool packages and transmits the fluid data in an interleaved series of slow type-A time blocks and fast type-B time blocks. For example, the time blocks may be generated and transmitted in an interleaved pattern in which three fast type-B time blocks are constructed and transmitted for each slow type-A time block, as generally depicted in FIG. 10 for the second transmission mode. In other instances, however, some other interleaved pattern could be used (e.g., with one, two, four, or more type-B time blocks transmitted for each type-A time block). Interleaving these fast and slow blocks allows for more frequent updates of the fast channels. For instance, an interleaved pattern of three type-B time blocks to each type-A time block with data decimated as above (five samples per fast channel per block of type-A or type-B, and one sample per slow channel per block of just type-A), results in twenty samples per fast channel and one sample per slow channel over a series of four time blocks.

Turning to the third and fourth transmission modes of FIG. 10, these modes are similar to that of the first and second transmission modes, respectively, but with block types C and D (having a proper subset of the OD channels) in place of block types A and B (having the full set of the OD channels). More particularly, in the third transmission mode the downhole tool packages and transmits the fluid data in a series of slow type-C time blocks uninterrupted by other time block types. If the data has been decimated in the same manner as discussed above with respect to the first transmission mode, the fast channels will have an update rate five times that of the slow channels. In the fourth transmission mode the fluid data is packaged and transmitted in an interleaved series of slow type-C time blocks and fast type-D time blocks. For example, the time blocks may be generated and transmitted in an interleaved pattern in which three fast type-D time blocks are constructed and transmitted for each slow type-C time block, as generally depicted in FIG. 10 for the fourth transmission mode. As noted above with respect to the second transmission mode, some other interleaved pattern could be used in other instances, and interleaving of the fast and slow blocks enables more frequent updates of the fast channels. In at least some instances, the alternation pattern of the block types of the second and fourth transmission modes can be programmed in the downhole tool (e.g., into a controller 100 of the downhole tool) by an operator as a fixed, interleaved pattern before deployment of the tool in a well.

The various time blocks types of FIG. 10 may include optical density data from multiple wavelength channels of a spectrometer of the downhole tool that is compressed together as a group, as generally discussed above. Further, certain other data channels could also be compressed together in groups (separate and apart from the group compression of the optical density data). For example, the water and oil fraction channels are presumably correlated and may be compressed together as a group. Additionally, the fluid composition channels should add to 100% (when measured as percentages) and can be compressed together as another group. It is again noted that the transmitted data block could be included in one or more data frames 218, with the bits of the data block sent within a single data frame 218 or divided over multiple data frames.

Figure 11:
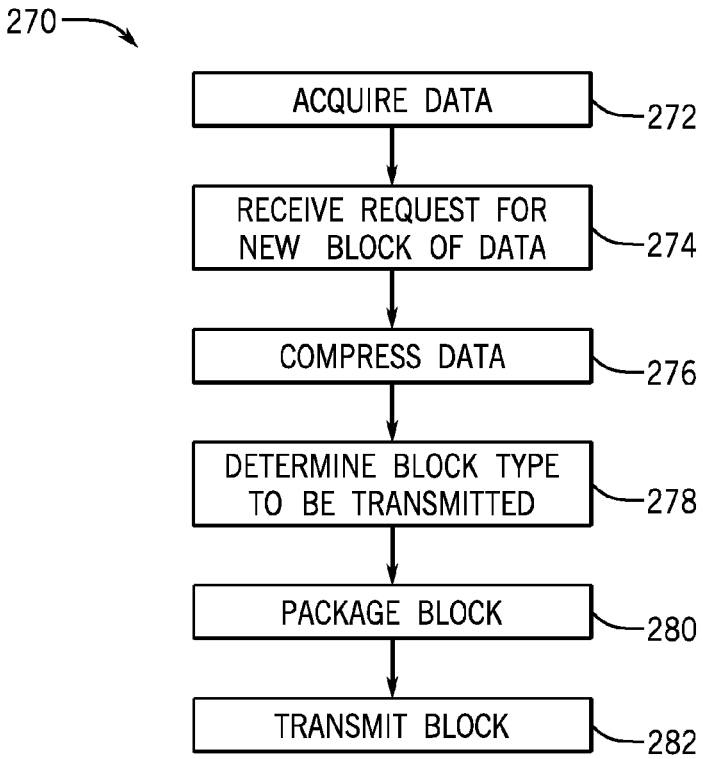
FIG. 11 is a flowchart for generating and transmitting data blocks, such as time blocks of compressed fluid data, on demand in accordance with one embodiment.

An example of a process for generating and transmitting on-demand blocks of data, such as the time blocks described above, is generally represented by flowchart 270 in FIG. 11. Formation fluid data can be acquired (block 272) through downhole fluid analysis by a downhole tool, as discussed above. In response to receipt (block 274) of a request for a new block of data, the acquired data can be compressed (block 276). As noted above, compression of the acquired data can include decimation, quantization, and encoding of data from various data channels, and the data of certain data channels (e.g., optical density channels) may be compressed as a group. The process may also include determining a block type that is to be transmitted (block 278) in response to the received request. In one embodiment, a controller 100 of the downhole tool is configured to allow a user to select the transmission mode from the multiple available transmission modes, and the determination of block 278 is made by referencing a saved transmission mode selection. In the case of transmission modes with fixed, interleaved patterns of time blocks, the determination of block 278 may also be made according to the fixed pattern associated with the selected transmission mode. A block of data may then be packaged (block 280) in accordance with the determined block type and transmitted (block 282), such as discussed above.

In another instance, however, the controller 100 of the downhole tool is configured to automatically change transmission modes during operation, such as based on the size of data blocks to be transmitted. This automatic change of transmission modes can include switching between different modes (such as those described above with reference to FIG. 10), changing an interleaved pattern of data blocks of different types (as in the second and fourth transmission modes of FIG. 10), or determining whether to package a slow block or a fast block based on the acquired data from which the data block is to be generated. The determination of the type of data block to be transmitted can be made in view of such automatic changes.

Figure 12:
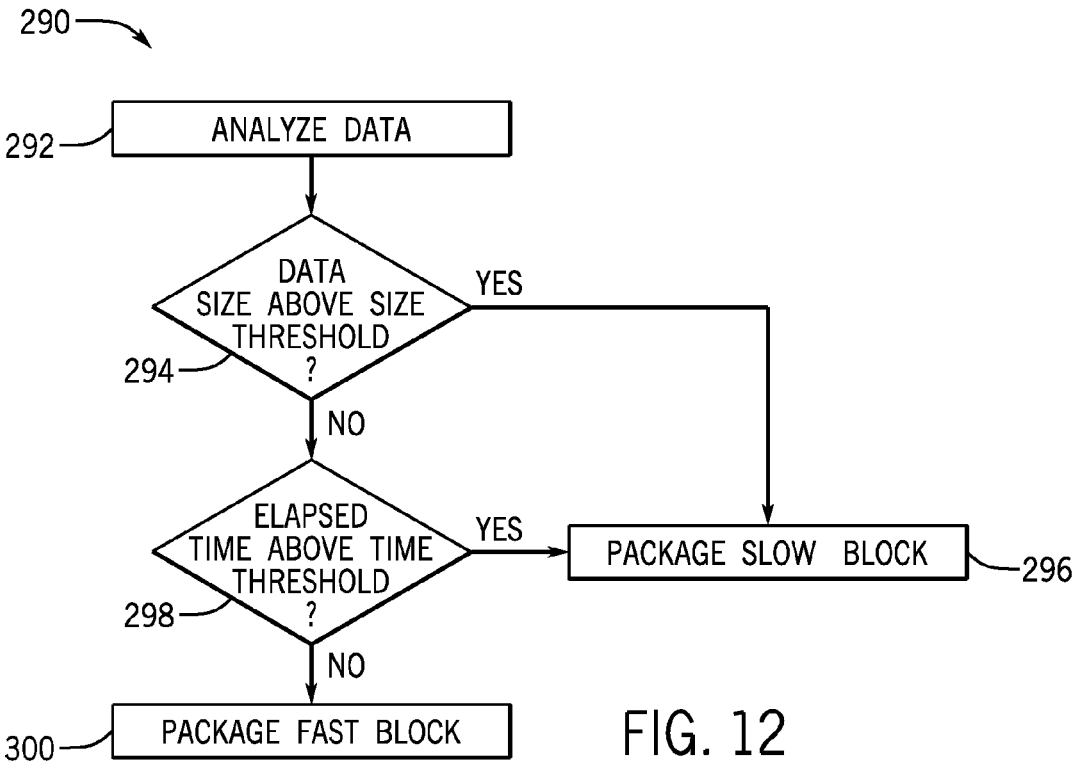
FIG. 12 is a flowchart representing an automated process for determining a type of on-demand block to be generated and transmitted in accordance with one embodiment.

One example of such an automated process is generally represented by flowchart 290 in FIG. 12. In this embodiment, the process may be used to determine a type of time block to be transmitted and includes analyzing data (block 292) for an elapsed period of time for possible inclusion in a time block. If the size of the analyzed data is above a size threshold (decision block 294), or if the elapsed time over which the data is acquired is above a time threshold (decision block 298), a slow block may be packaged (block 296). If, however, the data size and the elapsed time are both below their respective thresholds, a fast block may be packaged (block 300).

In other embodiments, the size and time thresholds could change based on desired update rates and previous block sizes and times. For example, if slow channels have a desired update rate of five minutes, the transmission time of fast blocks sent since the latest slow channel updates could be subtracted from five minutes and the type of the next block to be packaged could be determined as a function of expected transmission time for fast and slow blocks and the amount of time remaining before another update of the slow channels is desired. Slow blocks can be scheduled to provide the desired slow channel update rate and fast blocks can be transmitted between the slow blocks, where the number of fast blocks transmitted between two slow blocks depends on the size of the fast and slow blocks and the transmission speed.

The foregoing outlines features of several embodiments so that those skilled in the art may better understand aspects of the present disclosure. Those skilled in the art should appreciate that they may readily use the present disclosure as a basis for designing or modifying other processes and structures for carrying out the same purposes or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The invention claimed is:

1. A method comprising:

acquiring data for a formation fluid through downhole fluid analysis with a downhole tool in a well, wherein the downhole tool includes a spectrometer, and the acquired data includes optical spectrum data for the formation fluid measured with the spectrometer and other data for the formation fluid; and transmitting a subset of the acquired data from the downhole tool, wherein transmitting the subset of the acquired data includes:

generating time blocks of the acquired data, wherein generating the time blocks includes: compressing at least some of the acquired optical spectrum data according to a first compression technique, compressing at least some of the acquired other data for the formation fluid according to one or more additional compression techniques, and packaging the compressed optical spectrum data and compressed other data for the formation fluid into the time blocks, wherein at least some of the time blocks include both the compressed optical spectrum data and the compressed other data for the formation fluid; and transmitting the time blocks from the downhole tool up the well toward a surface installation wherein compressing the at least some of the acquired optical spectrum data includes:

separately compressing the at least some of the acquired optical spectrum data according to multiple different compression techniques, including the first compression technique;

comparing results of the compression of the at least some of the acquired optical spectrum data according to the multiple different compression techniques:

determining that compression of the at least some of the acquired optical spectrum data via the first compression technique yields fewer output bits than the other compression techniques of the multiple different compression techniques: and selecting the at least some acquired optical spectrum data compressed according to the first compression technique for inclusion in the time blocks.

2. The method of claim 1, wherein the transmitted subset of the acquired data includes data sampled from first data channels and data sampled from second data channels, and the sampled data of the first data channels are transmitted within the time blocks more frequently than the sampled data of the second data channels.

3. The method of claim 1, comprising the packaging the time blocks into data frames having additional data that is acquired by the downhole tool and is unrelated to the formation fluid, wherein at least some of the data frames include both the compressed optical spectrum data and the compressed other data for the formation fluid, and transmitting the time blocks from the downhole tool up the well includes transmitting the time blocks within the data frames from the downhole tool up the well.

4. The method of claim 3, wherein the transmitting the time blocks from the downhole tool up the well includes transmitting the time blocks in an interleaved pattern of time blocks up the well, the interleaved pattern of time blocks having first time blocks and second time blocks, the first time blocks each including both the compressed optical spectrum data for the formation fluid and the compressed other data for the formation fluid from a plurality of data channels, and the second time blocks each including both the compressed optical spectrum data for the formation fluid and the compressed other data for the formation fluid from a proper subset of the plurality of data channels.

5. The method of claim 4, wherein transmitting the time blocks in the interleaved pattern of time blocks up the well includes transmitting the time blocks in a fixed, interleaved pattern selected by an operator.

6. The method of claim 1, wherein the transmitted time blocks include at least some of the acquired optical spectrum data for each wavelength channel of the spectrometer.

7. The method of claim 1, wherein the transmitted time blocks include at least some of the acquired optical spectrum data for just a proper subset of wavelength channels of the spectrometer.

8. The method of claim 1, wherein compressing the at least some of the acquired optical spectrum data according to the first compression technique includes compressing optical spectrum data for multiple wavelength channels of the spectrometer together as a group according to the first compression technique.

9. A method comprising:

acquiring data for a formation fluid using multiple data channels with a downhole tool in a well, the multiple data channels including first and second subsets of data channels, wherein the first subset of data channels includes optical spectrum data channels having optical spectrum measurements for the formation fluid obtained with a spectrometer of the downhole tool and the second subset of data channels includes other data for the formation fluid; and communicating data of the first and second subsets of data channels from the downhole tool to an analysis system outside the well, wherein communicating the data of the first and second subsets of data channels includes:

selecting data from the first and second subsets of data channels, including selecting data from the first subset of data channels at a higher sample rate than from the second subset of data channels;

compressing the selected data from the first and second subsets of data channels, wherein compressing the selected data from the first subset of data channels includes compressing selected optical spectrum measurements from different channels of the optical spectrum data channels together as a group; and using mud-pulse telemetry to transmit the compressed data from the downhole tool wherein compressing the selected data includes:

separately compressing the selected data according to multiple different compression techniques, including a first compression technique;

comparing results of the compression of the selected data according to the multiple different compression techniques;

determining that compression of the selected data via the first compression technique yields fewer output bits than the other compression techniques of the multiple different compression techniques; and processing the selected data compressed according to the first compression technique for transmission from the downhole tool.

10. The method of claim 9, wherein communicating data of the first and second subsets of data channels from the downhole tool to the analysis system outside the well includes transmitting the compressed data in a series of time blocks.

11. The method of claim 10, wherein at least some of the time blocks of the series of time blocks include compressed data from both the first and second subsets of data channels.

12. The method of claim 11, wherein each of the time blocks including compressed data from both the first and second subsets of data channels includes at least one measurement from each of multiple channels of the second subset of data channels acquired during an amount of time covered by the time block and multiple measurements from each of multiple channels of the first subset of data channels acquired during the amount of time covered by the time block.

13. The method of claim 10, wherein the time blocks of the series of time blocks are created on demand by the downhole tool and vary in length.

* * * * *